US005259171A

United States Patent [19]

Hännikäinen

[11] Patent Number: 5,259,171

[45] Date of Patent: Nov. 9, 1993

[54] ASSEMBLY FOR GUIDED THREADING OF A WRAPPER

[75] Inventor: Jorma Hännikäinen, Lahti, Finland

[73] Assignee: Valmet Paper Machinery, Incorporated, Helsinki, Finland

[21] Appl. No.: 869,750

[22] Filed: Apr. 16, 1992

[30] Foreign Application Priority Data

Apr. 17, 1991 [FI] Finland ..... 911851

[51] Int. Cl.[5] ..... B65B 11/04

[52] U.S. Cl. ..... 53/465; 53/211; 53/215

[58] Field of Search ..... 53/118, 211, 212, 214, 53/215, 217, 389.4, 465, 587

[56] References Cited

U.S. PATENT DOCUMENTS

| | | | |
|---|---|---|---|
| 3,964,232 | 6/1976 | Bender et al. | 53/118 X |
| 4,224,782 | 9/1980 | Moflag | 53/211 X |
| 4,333,301 | 6/1982 | Koutonen et al. | 53/587 |
| 4,723,395 | 2/1988 | Koutonen | 53/211 X |
| 4,841,851 | 6/1989 | Quataert | 53/118 X |
| 4,945,707 | 8/1990 | Cosmo | 53/587 X |

FOREIGN PATENT DOCUMENTS

| | | | |
|---|---|---|---|
| 2128542 | 5/1984 | United Kingdom | 53/118 |

*Primary Examiner*—John Sipos
*Assistant Examiner*—Linda B. Johnson
*Attorney, Agent, or Firm*—Cohen, Pontani, Lieberman, Pavane

[57] ABSTRACT

An assembly and method for the guided threading of a wrapper for the wrapping of cylindrical objects, including a two-part frame (2, 3), a belt-like element (8, 9) for guiding the wrapper, and elements (4, 5, 6 and 7, 10, 11) attached to the frame, suitable for transferring the belt-like element (8, 9) to rest against the roll (1). The wrapper is guided by means of a roller chain (8, 9) comprised of a plurality of freely rotating rollers (17) which are linked to each other. The assembly incorporates two pairs of support arms placed to function in opposing directions with respect to rotating direction of the roll (1), the arm pairs comprising a lower support arm (5, 7) and an upper elongated support arm (4, 6), both pivotally mounted to the frame (2, 3), crank levers (10) attached to the pivotally mounted end of each support arm, and pneumatic cylinders (11) connected to each crank lever (10), capable of rotating the support arms (4, 5, 6 and 7) via the crank levers (10). There are two roller chains (8, 9) which are tightened between the ends of the support arms so that they can be transferred by means of the support arms (4, 5, 6 and 7) to rest against the roll (1).

15 Claims, 3 Drawing Sheets

3
14
13
10
11
A
12
7
19
9
6
1
1a
15
15
4
8
5
19
12
10
14
2
13
11

ASSEMBLY FOR GUIDED THREADING OF A WRAPPER

FIELD OF THE INVENTION

The present invention relates to an assembly for the guided threading of a wrapper about a cylindrical object or rol during a packaging operation.

BACKGROUND OF THE INVENTION

The present invention concerns in particular the techniques of wrapper threading in an apparatus for wrapping a roll. In conventional wrapping apparatuses a problem has been how to guide the start end of the wrapper about the roll so as to prevent the wrapper from creasing or detaching from the roll. A creased wrapper or an incorrectly guided wrapper, which is detached from the roll, may cause various disturbances during packaging operations and cause interruptions on the packaging line. A solution to the aforementioned problem has been sought by the application of glue to the inside of the wrapper, at least under the start end of the wrapper. However, the glue debris has been found to adhere to the equipment and cause splashing of the glue and, consequently, soiling of the environment as well as resulting operating disturbances. In addition, possible loose layers on the roll reduce the adherence of the first wrapper layer onto the roll surface.

Glue is not suitable in all cases for adhering the first wrapper layer. For instance, in the packaging of soft and porous paper grades such as different tissue papers or food-compatible papers, the use of an adhesive is excluded, because the adhesive can penetrate several web layers, thus spoiling the outermost layers on the roll. Furthermore, for a variety of reasons, the users of the paper roll may request for a package in which the first layer is not adhered with glue. The use of adhesives, however, improves the guided wrapper threading and the operating reliability of the wrapping station.

Guided threading of the wrapper and wrapping about the roll has been attempted by the use of different kinds of guide belts placed to surround the roll. The number of belts used can be, for example three, of which one is under the roll and one belt is located to both sides of the roll. Such apparatuses are quite expensive and the short belts are unable to conform sufficiently well to the roll surface, in particular, if the roll sizes vary.

U.S. Pat. No. 4,723,395 describes an assembly for wrapping rolls in a wrapper. Such an assembly comprises a support frame surrounding the roll, means for guiding the wrapper about the roll and at least one flexible guide belt which is adapted to compliantly conform to the roll's perimeter and to follow the rotation of the roll. The guide belt is arranged to travel as an endless band shaped approximately as a U-shaped track into which the roll to be wrapped is placed. The inner loop of the track is adapted to pass over four backing rolls which are mounted on a first lever arm and a pair of second lever arms so as to be transferable to rest against the surface of the roll to be wrapped. The belt passing over the backing rolls conforms to the surface of the roll to be wrapped during wrapping at all those points of the perimeter of the roll to be wrapped which remain between the three backing rolls.

A particular problem of such guiding threading with the help of the above described endlessly moving belt is caused by breakage of the belts due to operating disturbances and stress. The belts are stressed, i.e., because the belts must travel at a speed equal to the tangential speed of the roll, whereby the outermost layer of the roll may become creased and detach to form a clump under the belt or between the belts. In dual roll wrapping, the belt can jam between the rolls. The construction of the apparatus is therefore complicated and it conceals the wrapping area of the roll over a large sector of the roll's perimeter, even in the rest position of the apparatus. Because the belt is moved by the rotational motion of the roll, guided by several backing rolls and, moreover, must have a great length, the driving resistance of the belt easily tears the wrapper or the outermost layer of the roll. The transfer lever assembly of the belt becomes extremely complicated, since it must be capable of bringing the constant-length belt to enclose rolls of different sizes.

SUMMARY AND OBJECTS OF THE INVENTION

It is an object of the present invention to achieve a straightforward and reliable assembly for the guided threading of a wrapper and wrapping the wrapper over a roll or other cylindrical object.

The invention is based on the concept of guiding the wrapper by means of such a special-type roller chain in which the rollers can freely rotate on the envelope of the wrapped object or the wrapper.

More specifically, the method according to the present invention employing an assembly for the guided threading of a wrapper in the wrapping of cylindrical objects, including a frame, at least one belt-like element for guiding the wrapper, and elements attached to the frame, suitable for transferring the belt-like elements to rest against the roll, wherein the belt-like element is a roller chain comprised of a plurality of freely rotating rollers which are linked to each other. The present invention offers significant benefits.

The assembly for guided threading according to the present invention can be implemented with an extremely simple construction, because the chain itself is stationary during the rotation of the roll. Therefore, the need for belt backing rolls and complicated compensation and transfer lever arm assemblies is obviated. The invention also makes it possible to implement such a guided threading apparatus which in its rest position leaves the upper and lower sides of the roll unobstructed. The guiding function of the threading chain does not impose stresses on the roll surface, since only the individual rollers of the chain are rotated by the roll surface, whereby the rotational resistance exerted by the chain remains low. The chain can be made sufficiently strong, so it does not easily break when stressed by paper clumps or other disturbances. The chain is extremely wear-resistant, because it can be fabricated from durable materials and the chain elements are subject to wear only by rotational friction.

BRIEF DESCRIPTION OF THE DRAWING

The preferred embodiments are shown by way of example in the accompanying drawings in which.

DETAILED DESCRIPTION OF THE PREFERRED EMBODIMENTS

The above-mentioned FIGS. 1 to 5 are simplified diagrams of an embodiment of the assembly according to the present invention. To clarify the basic idea of the invention, details of conventional machine construction that are nonessential with respect to the spirit of the invention and known to those of ordinary skill in the art are omitted from the diagrams.

Figure 1:
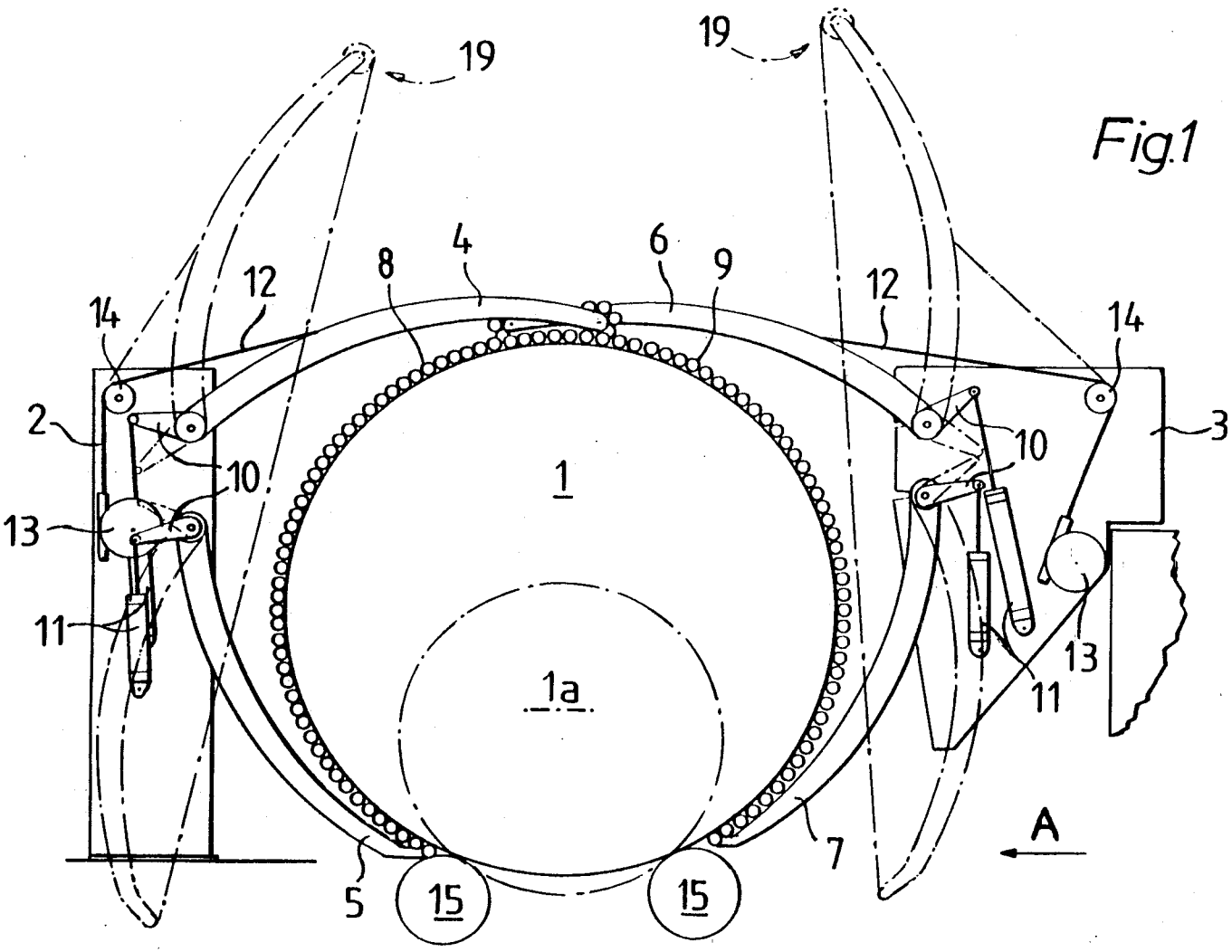
FIG. 1 shows an assembly according to the present invention viewed in the direction of the roll axis.

The assembly comprises two box-section frame parts 2 and 3, which are fixed to the floor foundation. In FIG. 1, the frame part plate facing the reader is omitted. Each of the frame parts 2, 3 carry two support arms 4, 5, 6 and 7. Located between the ends of both support arm pairs 4, 5 and 6, 7 are roller chains 8, 9, respectively. The opposite ends of the support arms 4, 5, 6 and 7 are pivotally attached to the frame and a crank lever 10 is mounted to the pivot end of each arm 4, 5, 6 and 7. The ends of the crank levers 10 are connected to the piston rods of pneumatic cylinders 11, while the other ends of the cylinders 10 are pivotally attached to the frames 2, 3. The first end of each of the roller chains 8, 9 is attached to the end of the corresponding lower support arm 5, 7 and the chains 8, 9 pass over the ends of the upper support arms 4, 6. Attached to the upper ends of the chains 4, 6 are cables 12, which serve for proper tensioning of the chains 8, 9. The cables 12 are tightened with the help of cable swivels 13 and the cables 12 pass over pulleys 14 placed above the swivels 13.

The rolls 1 are transferred to the wrapping station by a conveyor and lowered onto support rolls 15. A roll 1*a* of smaller size is drawn with a dashed line into the roll 1. Thus, the assembly makes it possible to wrap rolls of rather widely varying size provided that the design of the assembly is modified for the size range required. The assembly need not sense the roll size beforehand, because it can automatically conform to the perimeter of the roll to be wrapped.

Figure 3:
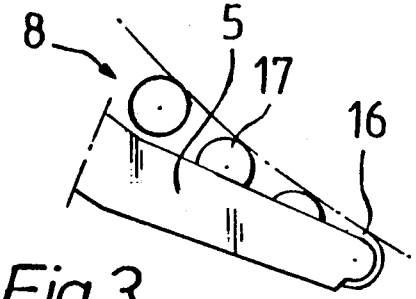
FIG. 3 shows a detail of the assembly of FIG. 1.
Figure 2:
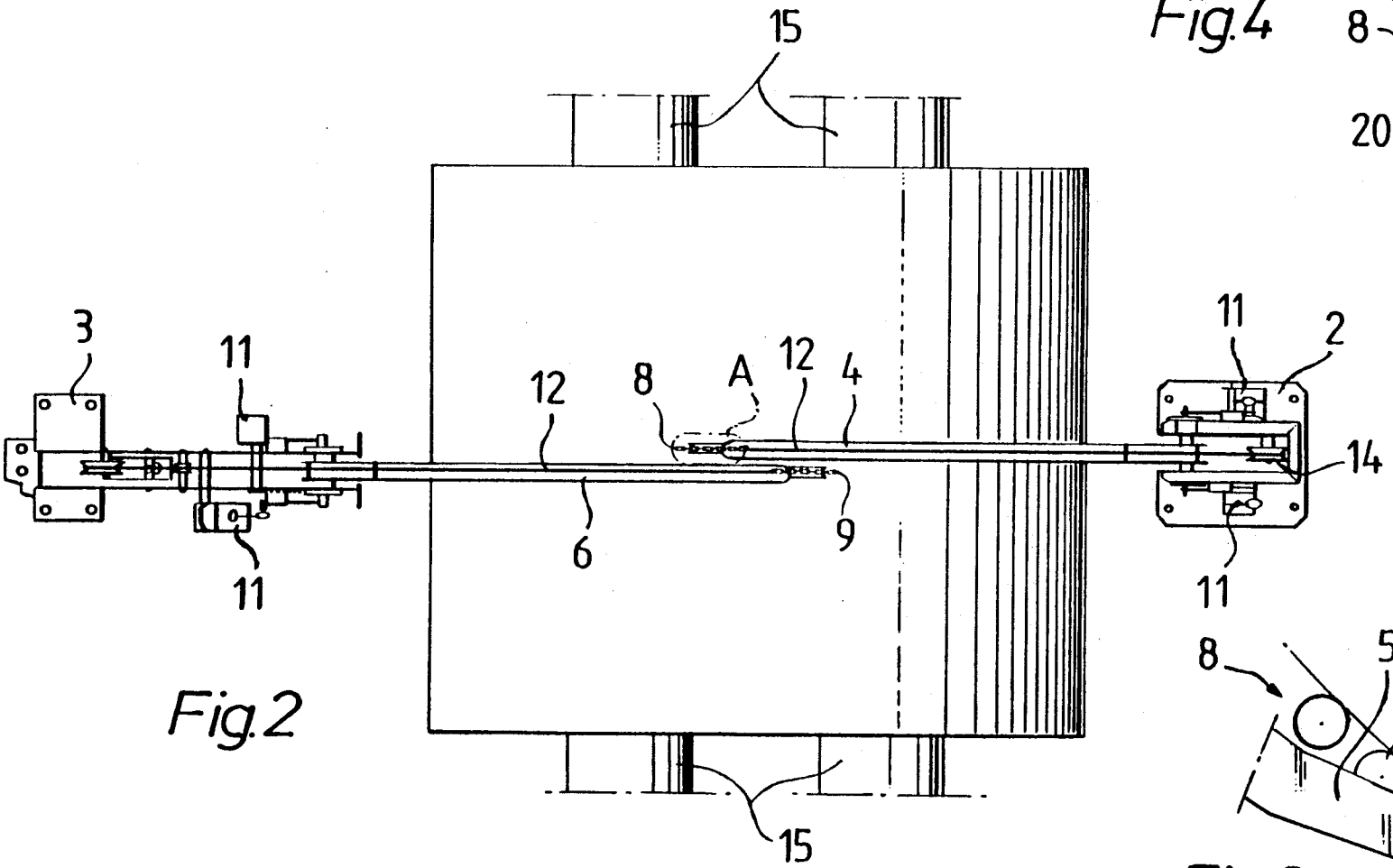
FIG. 2 shows the assembly illustrated in FIG. 1 in a top view.

FIG. 2 illustrates the assembly in a top view. The diagram shows the manner in which the upper support arms overlap, in parallel planes with each other, above the roll 1. FIG. 3 shows a feasible construction of the end of the lower support arm 5, 7. This design has the end of the roller chain 8, 9 connected by a shaft pin with riveted ends to the end of the support arm 5, 7 so that the shaft pin passes through the last roller 16 of the chain 8. This approach makes the rollers 17 of the tightened chain 8, including the last roller 16 at the chain end, conform to the perimeter of the roll 1 all the way down to the end of the support arm 5 in the manner shown by the dashed line.

Figure 4:
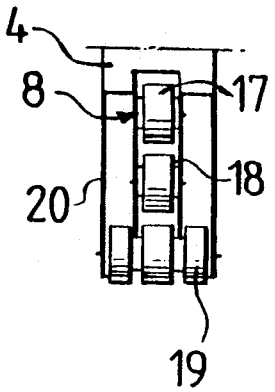
FIG. 4 shows another detail of the assembly of FIG. 1.

A preferred construction of the end of the upper support arms 4, 6 is shown in FIG. 4. For the tightening of the roller chains 8 and 9 about the roll to be wrapped, the chain 8 must pass over the end of the upper support arm 4 in order to make it possible to tighten the chain by means of the cable 12 and the cable swivel 13. The chain 8 passes about the end of the support arm 4 over a backing roll 19. The middle of the backing roll 19 has a radial groove which can sink or retain the chain, and the axial ends of the backing roll 19 are radially raised on both sides of the groove up to the same radius with the rollers 17 of the chain 8. The groove of the backing roll 19 may also have sprocket teeth with a pitch to match spaces between the rollers 17 of the chain 8. FIG. 4 also shows the structure of the roller chain 8. The chain 8 is fabricated in the same manner as a conventional roller chain comprised of link plates 18 and rollers 17 connected with the help of shaft pins. The present roller chain 8 differs from a conventional roller chain in that the diameter of the rollers 17 of the chain 8 is larger than the height of the link plates 18.

The function of the present invention is as follows. When the roll 1 to be wrapped is transferred to the wrapping station, the support arms 4 . . . 7 of both sides of the apparatus are in their open position as shown by the dashed lines in FIG. 1 and the roller chains 8, 9 are straightened between the ends of the support arms 4 . . . 7 by the cable swivel 13. As the roll 1 comes to rest, the support arms 4 . . . 7 are rotated by means of the pneumatic cylinders 1 1 actuating the crank levers 10 to touch the perimeter of the roll 1. When the backing rolls 16 and 19, i.e. the rollers 17 of the roller chain 8 on the backing rolls 16 and 19, at the ends of the support arms 4 . . . 7 rest against the surface of the roll 1, the roller chains 8 and 9 are tightened about the roll 1 by means of the cable swivels 13. Next, the roll 1 resting on the support rolls 15 is rotated and the wrapper is supplied by means of an appropriate threading apparatus from the direction indicated by the arrow A into the nip between the roll 1 and the support roll 15. From this nip the wrapper is guided into the second nip between the adjacent support roll 15 and the roll 1 and, on the other side of this nip in the direction of the wrapper travel in the nip, waits the end of the receiving support arm 5. Because the end of the arm 5 is situated immediately adjacent to the nip, the wrapper is guided by the roller 16 at the end of the support arm 5 to enter the nip between the roller chain 8 and the roll 1. When the wrapper end reaches the topside of the roll 1, it is guided by the chain 8 to enter between the roll 1 and the receiving chain 9, which is situated overlapping around the circumference of the roll in a parallel plane with the chain 8. The wrapper end is further guided by the chain 9 back into the nip between the support roll 15 and the roll 1 where the wrapper start end remains trapped with the wrapper finish end and the roll 1.

The roll 1 is rotated until a sufficient number of wrapper layers is wrapped about the roll 1. The finish end of the wrapper is attached to the roll 1 using, e.g., glue, after which the support arm 4, 5, 6 and 7 are rotated to their rest positions aside from the roll 1 and the roll can be transferred further along the line. When the arms are in their rest positions, the upper and lower portions of the roll 1 remain unobstructed and space requirements of the apparatus still remain minimal in the sideways or horizontal direction.

When the roll 1 to be wrapped is rotated, while the chains 8 and 9 are resting against the roll perimeter, the roll 1 rotates each roller 17 of the chains 8, 9. Because the chains 8, 9 need not be pulled very tight against the roll 1 and the wrapper surface, the rollers 17 rotate with an extremely light force both radially and tangentially, thus causing no stresses or damage to top layers or wrapper of the roll 1 by the chains 8, 9 and the roller 17. The rollers 17 can be made of polyamide or other low-friction and durable material. The surface of the rollers 17 can be coated with rubber or other high-friction material to avoid slipping of the rollers 17 on the surface of wrapper or the roll 1 and, if desired, the rollers 17 can be mounted on the shaft pins of the chains 8, 9 using bearings such as, e.g., PTFE bushings. When necessary, the chain can be made as a two-row or multiple-row chain. Further, the term "chain" must in this context be understood to mean all chain-like, belt-like and other elements which can be used to link freely rotating rollers into an elongated flexible member.

Figure 5:
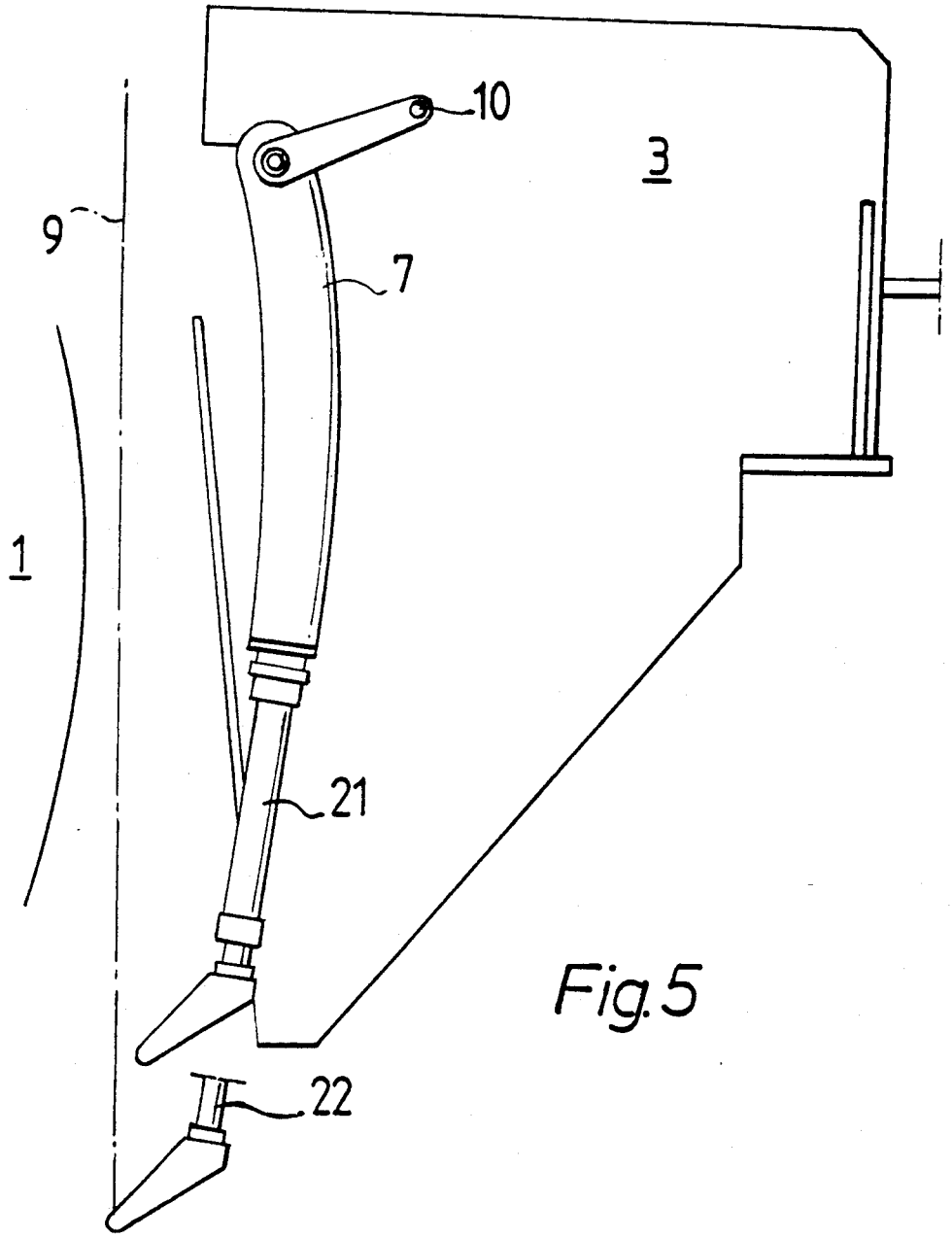
FIG. 5 shows a detail of another embodiment of the present invention.

The construction of the assembly according to the invention varies according to the requirements imposed by the other equipment of the wrapping station, while the wrapper feed apparatus sets the greatest limitations for the final implementation of the assembly in each case. In the above-described embodiment, the length of the lower support arm 7 on the wrapper feed side is fixed, whereby its use in conjunction with some types of wrapper feed apparatuses may require a slot in the wrapper feed table. If the end of the lower support arm 7 on the wrapper feed side is provided with a pneumatic cylinder 21, as shown in the embodiment of FIG. 5, to whose piston rod 22 the end of the chain 9 is attached, the end of the support arm 7 with the chain 9 can be pushed by means of the cylinder 21 close to the nip between the roll 1 to be wrapped and the support roll 15. Correspondingly, at the end of wrapping, during the rotation of the lower support arm 7 to its rest position, the end of the support arm 7 is withdrawn from nip, whereby the length of the arm 7 is contracted sufficiently to allow the rotation of the support arm to its rest position, thus obviating the need of a slot in the wrapper feed table. In this embodiment the pneumatic cylinder 21 can be a nonrotating dual-rod cylinder as shown in FIG. 5, or alternatively, a single-rod cylinder complemented with a suitable guiding element to prevent the rotation of the piston rod of the cylinder.

In addition to those described above, the present invention can have alterative embodiments. Thus, the number of the roller chains 8, 9 can be varied, and the chains can be fitted against the perimeter of the roll 1 in different ways. For example, the chain can be guided to enclose the roll by means of a guide track surrounding the roll, whereby the chain is pulled about the roll with the help of a carriage running along the track. In this embodiment, the end points of the guide track must be selected so that the chain meets the roll perimeter at the start and finish ends of the track. The excess chain in its rest position is stored, e.g., wound to form a storage roll which can simultaneously be used for tightening the chain against the roll. The guide track in such instance can also be replaced by telescoping arms. Rotation of the support arms can be implemented using different kinds of actuators such as rotating cylinders or other torque-exerting devices which can impose a rotating moment directly to a pivot point, and the tightening of the chains and cables can be attained with the assistance of various types of tightening apparatuses.

The construction of the guided threading assembly is, of course, affected by the direction from which the wrapper is fed about the roll and the implementation of the guided threading assembly must be designed separately for each wrapper feed method. The appraratus may therefore be assymetrical. If the wrapper is fed from above the roll, the chain may not cross at the feed point. The actuators of the assembly can be any type of actuating means capable of implementing the required motions, and simple control valve systems are sufficient for steering the actuators. According to needs and with the use of other kinds of actuators, the control system can be implemented using a programmable logic control system or the assembly can be interfaced to the computer which controls the wrapping line.

I claim:

1. An assembly for the guided threading of a wrapper about a rotatable cylindrical object having a predetermined circumference, comprising:

a frame having a first part (2);

a roller chain comprising a belt-like member (8) having two end and a plurality of freely rotating roller (17) mounted on and linked to each other by said belt-like member for guiding the wrapper about the cylindrical object;

means for rotating the cylindrical object about an axis to wrap the cylindrical object; and positioning means, operatively connected to said frame (4, 5) for positioning said roller chain about a portion of the circumference of the rotatable cylindrical object (1), said positioning means comprising an upper elongated support arm (4) having an upper free end and a fixed end pivotably attached to said first part (2) of said frame and a lower support arm (5) having a lower free end and a fixed end pivotably attached to said first part (2), said ends of said roller chain (8) being secured to said upper and lower free ends, said upper and lower free ends (4, 5) maintaining the roller chain stationary relative to the frame and the axis of the rotatable cylindrical object while permitting said plurality of rollers to freely rotate while said cylindrical object is rotated.

2. The assembly according to claim 1, wherein the circumference of the cylindrical object is provided with a plurality of points, said positioning means further comprising means for positioning said roller chain (8) to rest against at least two different points on the circumference of the cylindrical object.

3. The assembly according to claim 2, further comprising means for tightening said roller chain (8) from a resting position to a position wherein said roller chain rests against the cylindrical object so that said rollers (17) of said chain (8) come to rest against the circumference of the cylindrical object (1).

4. The assembly according to claim 1, said frame having a second part (3), said assembly comprising a second roller chain and a second positioning means associated with said second roller chain, wherein said second positioning means comprises a lower and (7) and an upper (6) elongated support arm, each said arm having a fixed end, a free end and a crank lever (10) mounted thereto and being pivotally mounted at said fixed end to said second part of said frame (3) and a pneumatic cylinder (11) connected to said crank lever (10) for rotating said support arms (6, 7) about said pivot point with respect to said frame, said second roller chain being positioned around a portion of the circumference of the rotatable cylindrical object and secured to said free ends of said support arms (6, 7), said free end of said support arms (6, 7) maintaining the roller chain stationary relative to the frame and the axis of the rotating cylindrical object while permitting said plurality of rollers to freely rotate.

5. The assembly according to claim 4, further comprising a pneumatic cylinder (11) whose piston rod is displaceably linked to said free end of said lower support arm (7) of said second positioning means for moving said lower support arm.

6. The assembly according to claim 4, wherein each of said roller chains (8, 9) has a first end and a second end, said first end being connected to said free end of one of said lower support arms (5, 7) and said second end passing about a backing roll (19) located at said free end of said upper support arm (4, 6).

7. The assembly according to claim 6, further comprising a cable transmitting a tensile force between said second end of each said roller chain and a tightening means for increasing a tension in each said roller chain about said backing roll (19).

8. The assembly according to claim 6, wherein said free ends of said upper support arms (4, 6) are situated adjacent to each other in parallel planes when said roller chains (8, 9) are tightened by said tightening means against the cylindrical object (1) to be wrapped.

9. The assembly according to claim 1, comprising two roller chains (8, 9) and two positioning means, wherein each of said roller chains is associated with a different one of said positioning means.

10. A method of wrapping a cylindrical object, in an apparatus comprising a frame, a roller chain comprising a belt-like member having two ends and a plurality of freely rotating rollers mounted on and linked to each other by the belt-like member for guiding the wrapper, and a positioning member having a lower and upper support arm each having a fixed end attached to the frame, said lower and upper support arms having free ends for securing said ends of said roller chain and for maintaining said roller chain stationary relative to the rotating cylindrical object for positioning the roller chain against the cylindrical object (1), said method comprising the steps of:

(a) moving the positioning member to an open position;

(b) inserting the object between the support arms which secure the roller chain;

(c) positioning the positioning member so that the roller chain is maintained substantially stationary relative to the frame and the axis of the cylindrical object while permitting the rollers to freely rotate while the cylindrical object is rotated;

(d) rotating the cylindrical object while feeding a wrapper between a nip formed by the cylindrical object and the roller chain, so that the wrapper is advanced between the roller chain and the cylindrical object.

11. The method according to claim 10, comprising the further steps of:

rotating the cylindrical object until a sufficient number of wrapper layers is wrapped about the cylindrical object in an outwardly expanding spiral;

attaching the finish end of the wrapper to the cylindrical object; and positioning the positioning member so that the cylindrical object may be removed.

12. The method according to claim 10, wherein the roller chain is supported by support arms and wherein in said positioning step said positioning member further comprises a pneumatic cylinder, said positioning step further comprising rotating the arms by means of the pneumatic cylinder so that a portion thereof touches the cylindrical object.

13. The method according to claim 12, wherein the apparatus further comprises an extension pneumatic cylinder whose piston rod is displacably linked to an end of the roller chain, the extension pneumatic cylinder being mounted on the free end of one of the support arms, further comprising the step of, after said rotating step, retracting the piston rod.

14. The method according to claim 12 wherein the arms further comprise backing rolls at a free end thereof, the roller chain being turnable about the backing rolls, further comprising the step of, after the positioning member causes the rollers to rest against the cylindrical object, tensioning the roller chain by applying a force to the roller chain at a position distal to the backing rolls.

15. The method according to claim 14, wherein a first roller chain forms a first nip with the cylindrical object and a second roller chain forms a second nip with the cylindrical object, comprising the step of advancing the wrapper from the first nip to the second nip as the cylindrical object is rotated.

* * * * *